US006450904B1

(12) United States Patent
Yeh

(10) Patent No.: US 6,450,904 B1
(45) Date of Patent: Sep. 17, 2002

(54) STRING FOR A RACKET

(76) Inventor: Peter Yeh, No. 151, Jen-Mei Rd., Ho-Mei Chen, Chang-Hua Hsien (TW)

( * ) Notice: Subject to any disclaimer, the term of this patent is extended or adjusted under 35 U.S.C. 154(b) by 0 days.

(21) Appl. No.: 09/676,404

(22) Filed: Sep. 29, 2000

(51) Int. Cl.[7] ..... A63B 49/00; A63B 51/02
(52) U.S. Cl. ..... 473/543; 473/524
(58) Field of Search ..... 473/543, 537, 473/524; 428/373, 374

(56) References Cited

U.S. PATENT DOCUMENTS 4,339,499 A * 7/1982 Tappe et al. ..... 428/373
4,860,531 A * 8/1989 Wells et al. ..... 57/234
4,956,236 A * 9/1990 Want ..... 428/373
5,090,188 A * 2/1992 Lin et al. ..... 57/234
5,327,714 A * 7/1994 Stevens et al. ..... 57/230
5,922,462 A * 7/1999 Kent et al. ..... 428/373
6,009,699 A * 1/2000 Delvael ..... 57/232

FOREIGN PATENT DOCUMENTS

EP 377362 * 7/1990 ..... 473/FOR 171

* cited by examiner

*Primary Examiner*—Raleigh W. Chiu
(74) *Attorney, Agent, or Firm*—Townsend and Townsend and Crew LLP

(57) ABSTRACT

A string for a sports racket includes a toothed core made of a first plastic material and having a toothed outer surface, and a sheath layer made of a second plastic material and molded over the core so as to be bonded to the toothed outer surface. The first plastic material has a hardness and a wear-resistance less than those of the second plastic material.

8 Claims, 4 Drawing Sheets

STRING FOR A RACKET

BACKGROUND OF THE INVENTION

1. Field of the Invention

This invention relates to a string for a sports racket, more particularly to a string having a toothed core and a sheath layer molded over the toothed core.

2. Description of the Related Art

A known type of conventional racket string is formed of a plurality of core filaments which are twisted together upon passing through an impregnating container carrying a thermoplastic resin inside for impregnating the filaments so as to increase the elasticity of the string. This type of string generally has poor wear-resistance. When the string is used in a racket, high impact and friction induced upon hitting a ball would result in severe wearing of the string.

Another conventional string is formed of a plurality of core filaments sheathed by a moisture-cured polyurethane which provides hardness to increase the wear-resistance of the string. However, this type of string has poor elasticity. Thus, reactive force produced in the string upon impact may injure the user's hand.

SUMMARY OF THE INVENTION

Therefore, it is an object of the present invention to provide a string for a sports racket that has a structure capable of providing good wearresistance and elasticity.

Accordingly, a string for a racket of the present invention comprises: a toothed core made of a first plastic material and having a toothed outer surface; and a sheath layer made of a second plastic material and molded over the core so as to be bonded to the toothed outer surface. The first plastic material has a hardness and a wear-resistance less than those of the second plastic material.

BRIEF DESCRIPTION OF THE DRAWINGS

In drawings which illustrate embodiments of the invention.

DETAILED DESCRIPTION OF THE PREFERRED EMBODIMENTS

Figure 1:
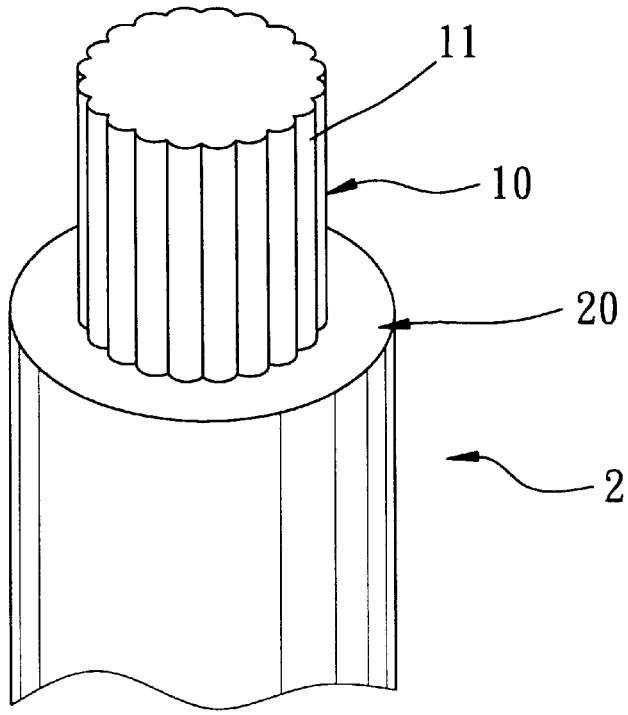
FIG. 1 is a perspective view of a segment of a string embodying the present invention.
Figure 2:
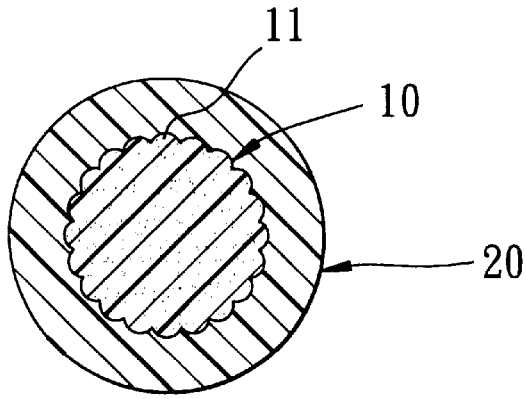
FIG. 2, is a cross-sectional view of the string of FIG. 1.

FIGS. 1 and 2 illustrate a segment of a string 2 embodying this invention for a sports racket. The string 2 includes a toothed core 10 made of a first plastic material and having a toothed outer surface 11, and a sheath layer 20 made of a second plastic material and molded over the core 10 so as to be bonded to the toothed outer surface 11. The toothed outer surface includes a plurality of rounded teeth so as to enhance the bonding of the sheath layer 20 and the core 10.

The first plastic material has a hardness and a wear-resistance less than those of the second plastic material. Preferably, the first plastic material is made of polyurethane or nylon, and the second plastic material is made of polyester.

Figure 3:
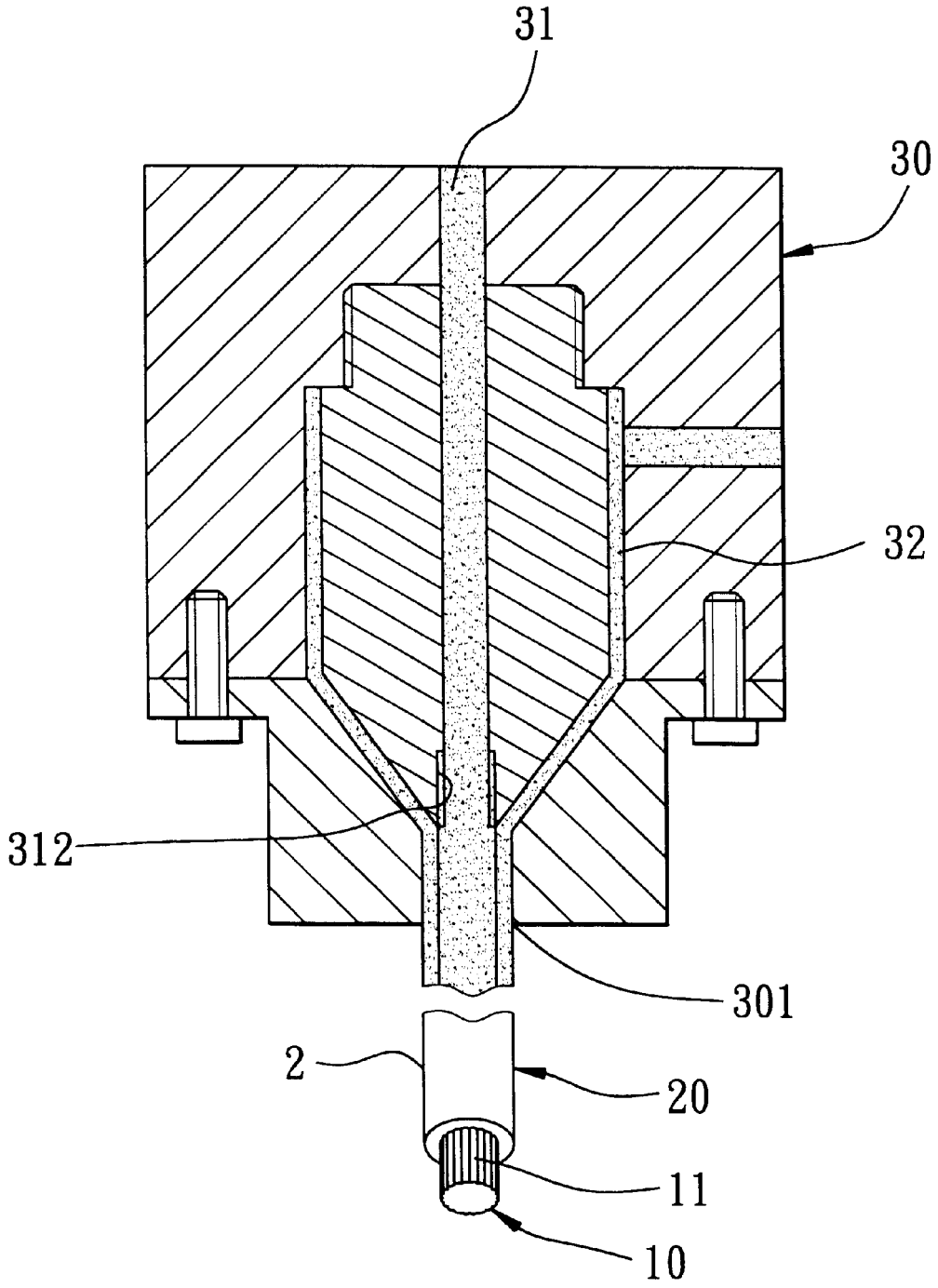
FIG. 3 is a cross-sectional side view to illustrate formation of the string of FIG. 1 via an extruder.

Referring now to FIG. 3, in combination with FIGS. 1 and 2, the string 2 is preferably prepared by co-extruding the first and second plastic materials via an extruder (only a die unit 30 of the extruder is shown in FIG. 3).

The die unit 30 includes separate first and second flow passageways 31, 32 for passage of the first and second plastic materials, respectively. The first passageway 31 is surrounded by the second passageway 32, merges with the second passageway 32 at a position close to a die orifice 301, and has an outlet with an inner toothed surface 312 so as to form the string 2.

Figure 6:
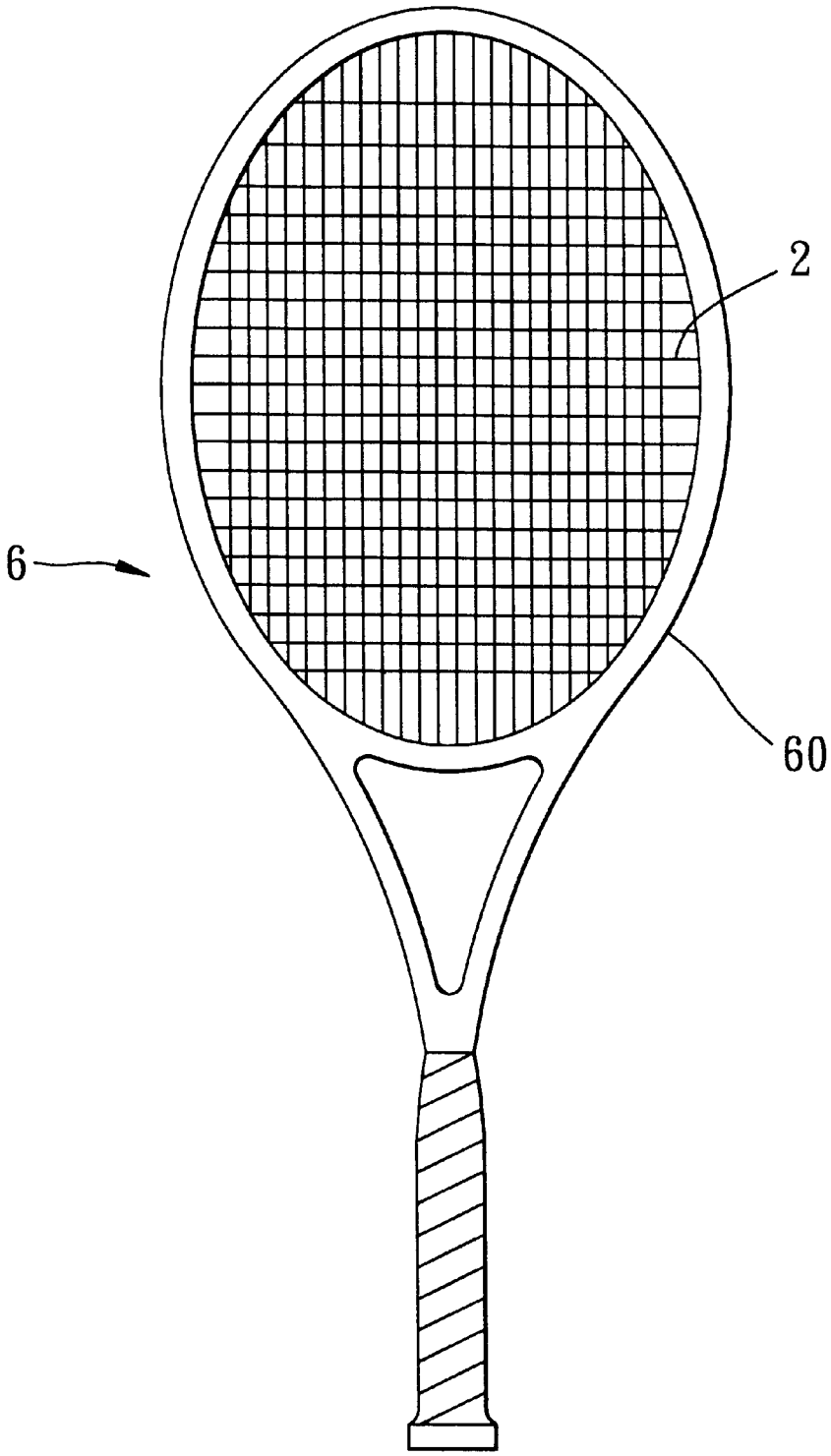
FIG. 6 is a perspective view of a sports racket having a cord netting of the string of FIG. 1.

The string 2 has a structure that is soft in the inside and hard on the outside which provides the string 2 with good elasticity and wear-resistance, thereby increasing the service life when used in a sports racket 6 (see FIG. 6). The sports racket 6 shown in FIG. 6 includes a racket frame 60 and a cord netting of the string 2 stretched in the frame 60.

Figure 4:
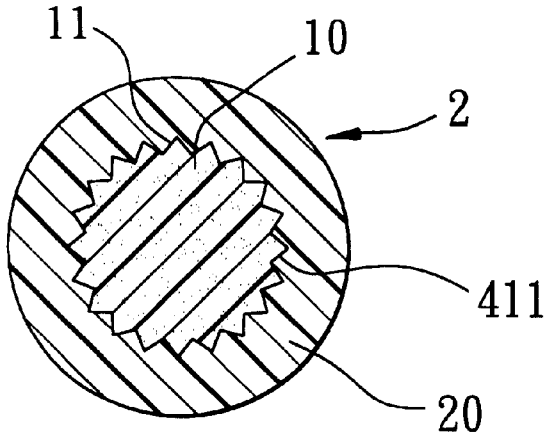
FIG. 4 is a cross-sectional view to illustrate a modified embodiment of the string of FIG. 1.

FIG. 4 illustrates a modified embodiment of the string 2 of the previous embodiment. In this embodiment, the toothed outer surface 11 includes a plurality of sharp teeth 411.

Figure 5:
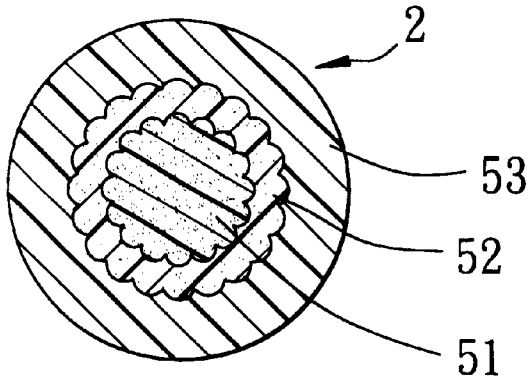
FIG. 5 is a cross-sectional view to illustrate another modified embodiment of the string of FIG. 1.

FIG. 5 illustrates another modified embodiment of the string 2 of the previous embodiment. In this embodiment, the string 2 includes a toothed core 51 made of a third plastic material, a toothed first sheath layer 52 molded over the core 51 and made of a fourth plastic material, and a second sheath layer 53 molded over the first sheath layer 52 and made of a fifth plastic material. Preferably, the string 2 is prepared by co-extruding the third, fourth, and fifth plastic materials via an extruder (not shown). Preferably, the third and fourth plastic materials are independently polyurethane or nylon, and the fifth plastic material is polyester. More preferably, the third plastic material is thermoplastic polyurethane, the fourth plastic material is nylon, and the fifth plastic material is polyester.

Since the string 2 is prepared by extrusion, the production rate can be significantly increased as compared to the conventional string prepared by a process involving steps of filaments twisting, resin impregnating, etc.

With the invention thus explained, it is apparent that various modifications and variations can be made without departing from the spirit of the present invention. It is therefore intended that the invention be limited only as recited in the appended claims.

I claim:

1. A racket, comprising:

a racket frame; and a cord netting stretched in said frame;

said cord netting comprising a string that is composed of a core made of a first plastic material and having a toothed outer surface formed by adjoining teeth on a periphery of the core, each tooth having a base width which is greater than a height of the tooth, and a sheath layer made of a second plastic material and molded over said core so as to be bonded to said teeth, said first plastic material having a hardness and a wear-resistance less than a hardness and wear-resistance of said second plastic material.

2. The racket of claim 1, wherein said first and second plastic materials are co-extruded via an extruder to form said core and said sheath layer.

3. The racket of claim 1, wherein said first plastic material is polyurethane.

4. The racket of claim 1, wherein said first plastic material is nylon.

5. The racket of claim 3,wherein said second plastic material is polyester.

6. The racket of claim 3, wherein said second plastic material is polyester.

7. The racket of claim 1, wherein said teeth have a rounded teeth outer surface.

8. The racket of claim 1, wherein said teeth have a sharp teeth outer surface.

* * * * *